United States Patent [19]

Hisaoka et al.

[11] Patent Number: 4,457,691

[45] Date of Patent: Jul. 3, 1984

[54] PULSE BURNERS

[75] Inventors: Satoshi Hisaoka, Fujinomiya; Toshihiko Saito, Yokohama, both of Japan

[73] Assignee: Tokyo Shibaura Denki Kabushiki Kaisha, Kawasaki, Japan

[21] Appl. No.: 451,422

[22] Filed: Dec. 20, 1982

[30] Foreign Application Priority Data

Dec. 25, 1981 [JP] Japan ..... 193798

[51] Int. Cl.[3] ..... F23C 11/04

[52] U.S. Cl. ..... 431/1

[58] Field of Search ..... 431/1

[56] References Cited

U.S. PATENT DOCUMENTS 2,907,382 10/1959 McIlvaine ..... 431/1

3,005,485 10/1961 Salgo et al. ..... 431/1

FOREIGN PATENT DOCUMENTS 102804 8/1980 Japan .

*Primary Examiner*—Carroll B. Dority, Jr.

*Attorney, Agent, or Firm*—Stevens, Davis, Miller & Mosher

[57] ABSTRACT

In a pulse burner of the type wherein an air-fuel mixture in a combustion chamber is explosively burnt by an ignition plug, a flapper valve repeatedly opens and closes an air inlet passage and a fuel inlet passage so as to repeat explosive combustion of an air-fuel mixture at a high frequency, there is provided a flame detector which interrupts the ignition plug and a fan for supplying air into the combustion chamber once the combustion has started normally.

3 Claims, 1 Drawing Figure

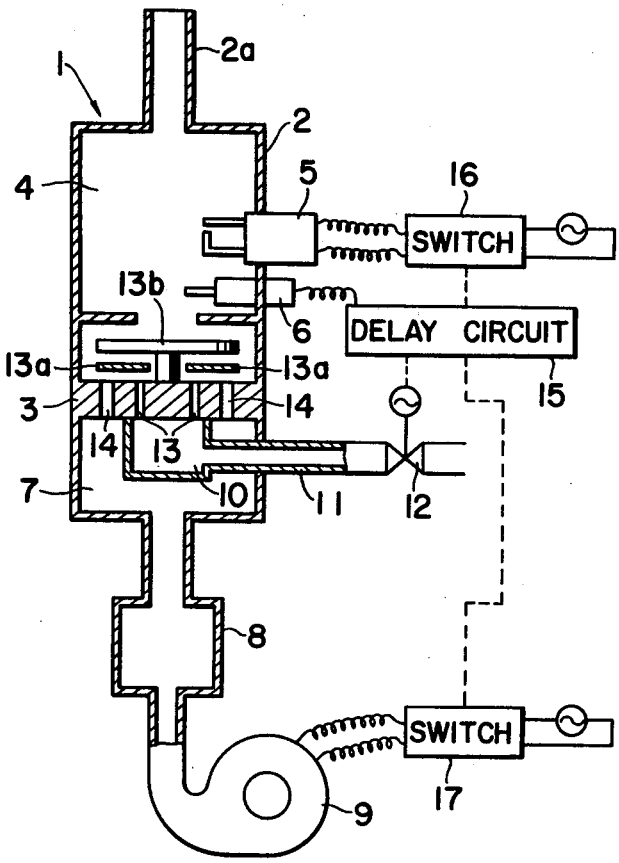
1
2a
2
4
5
16
SWITCH
13b
6
DELAY CIRCUIT
13a
13a
15
3
14
14
13
7
10
11
12
8
SWITCH
17
9

PULSE BURNERS

BACKGROUND OF THE INVENTION

This invention relates to a pulse burner incorporated into a water heater or air heater utilized in residences, shops or offices of relatively small size.

In prior art combustion systems, such continuous combustion systems as Bunzen type or Gun type have been used in which gas (usually town gas or propane gas) is burnt continuously with a burner disposed at the lower portion, and the combustion gas is sent to a heat exchanger to heat water or air. In this system, in order to increase the heat efficiency it is necessary to increase the heat transfer area of the heat exchanger or to increase the number or density of combustion gas flow passages. This not only increases the sizes of the heater and fan supplying combustion air but also complicates the mechanism.

In recent years, so called pulse burners have been developed and are disclosed in many publications. In principle, the pulse burner resembles a two cycle gasoline engine, in which fuel and air are sucked into a combustion chamber of a relatively small volume, the mixture is caused to explode by an ignition plug and then exhausted through a heat exchanger in the form of a relatively fine pipe. When explosion occurs, the pressure in the combustion chamber increases greatly thereby to close a flapper valve for stopping suction of the airfuel mixture. Under this condition, the combustion gas is exhausted to the outside of a building via the heat exchanger, thereby creating a negative pressure therein. Then the flapper valve opens automatically to suck again the air-fuel mixture into the combustion chamber. This cycle of operation is repeated at a frequency of 35–80 Hz/sec. The pulse burner has revolutionary advantages over conventional gas or oil burners. More particularly, its heating efficiency is 91 to 96%, meaning saving of fuel and miniaturization of the apparatus, and it does not need a chimney because the combustion product is exhausted at a high speed and high pressure and because the temperature of the exhaust gas is lower than 38° C. Accordingly, an inexpensive plastic pipe (polyvinyl chloride pipe, for example) can be used to extend horizontally to the outdoor through the wall of a building. Without a vertical chimney, heat loss during off cycle is very small. Unexpectedly, the noise cause by frequent explosions is less than 100 dB and can be reduced substantially by suitable means. Moreover, the concentration of the harmful components of the exhaust gas, for example CO, is of the order of less than 0.025% and can be reduced to 0.01–0.005% by volume by suitably selecting the volume of the combustion chamber and the diameter of the exhaust pipe. Irrespective of these advantages, in the prior art pulse burner, the operation of the spark plug and the fan was not satisfactory because of delayed response or miss operation of a flame detector.

SUMMARY OF THE INVENTION

Accordingly, an object of this invention is to provide a novel pulse burner in which, once the combustion is started, operations of a fan for supplying combustion air and an ignition plug are stopped to save energy.

As a result of our investigation we have found that the flapper valve can be operated automatically by high and low pressures in the combustion chamber and that the temperature in the combustion chamber is maintained at a temperature sufficiently high enough to ignite the air-fuel mixture by flame, or combustion product partially remaining in the combustion chamber.

According to this invention, there is provided a pulse burner comprising a combustion cylinder provided with an ignition plug, a fuel inlet passage for supplying fuel into the combustion cylinder, an air inlet passage connected to a fan for supplying combustion air into the combustion cylinder, flapper valve means operated by pressure variation caused by explosion in the combustion cylinder and exhaust of combustion product therefrom whereby the flapper valve means repeatedly opens and closes the fuel inlet passage and the air inlet passage, and a flame detector installed in the combustion cylinder for stopping operations of the ignition plug and the fan once the combustion has started.

BRIEF DESCRIPTION OF THE DRAWING

In the accompanying drawing, the single FIGURE is a diagrammatic longitudinal sectional view showing one embodiment of the pulse burner embodying the inven- tion.

DESCRIPTION OF THE PREFERRED EMBODIMENT

A pulse burner generally designated by a reference numeral 1 is adapted to heat water and comprises a combustion cylinder 2 with its interior partitioned into an upper combustion chamber 4 and a lower air chamber 7 by a horizontal partition wall 3. On the side wall of the upper combustion chamber 4 are mounted an ignition plug 5 and a flame detector 6. A small diameter pipe **2*a* connected to the upper end of the combustion cylinder 2 and acting as an exhaust pipe is led to a heat exchanger, not shown, to heat water or air. The flame detector 6 utilized in this example is of the type which detects electric current flowing through the flame and amounting to about 10 microamperes at an operating voltage of 100 V. A delay circuit 15 is connected on the output side of the flame detector 6. An air chamber 7 beneath the partition wall 3 is connected to a fan 9, preferably a sirocco fan, through a muffler 8. A fuel or gas box 10 is contained in the upper portion of the air chamber 7 beneath the partition wall 3. The gas chamber 10 is communicated with a source of gas via a conduit 11 and an electromagnetic valve 12 for controlling the quantity of gas supplied to the combustion chamber 4 under the control of the delay circuit 15. The output pressure of the fan 9** is selected to form an air-fuel mixture of a predetermined pressure.

The partition wall 3 is provided with one or more air inlet ports 14 opening on the outside of the gas chamber 10 and one or more gas inlet ports 13 opening inside of the gas chamber 10. An annular disc shaped flapper valve **13*a* is provided in the bottom of the combustion chamber 4 to open and close the air and gas inlet ports 13 and 14 each time the air-fuel mixture explodes. A stop member 13*b* is provided above the flapper valve 13*a* to limit the upward movement thereof. The output signal of the delay circuit 15 is supplied to switch 16 included in the ignition circuit, the electromagnetic valve 12 and a switch 17 for the fan 9. Thus, when the flame detector 6 detects a flame, the electromagnetic valve 12 is opened to continue supply of gas, and switches 16 and 17 are opened to deenergize the ignition plug 5 and the fan 9**.

The pulse burner shown in the accompanying drawing operates as follows:

Thus, upon closure of switch 17 the fan 9 supplies fresh air into the combustion chamber 4 via air chamber 7 and air inlet ports 14. The time required for filling the combustion chamber 4 with fresh air is determined by the capacity of the fan 9. After that, the electromagnetic valve 12 is opened to supply fuel gas into the combustion chamber 4 via gas chamber 10 and gas inlet ports 13 to form an air-gas mixture. Then, the ignition switch 16 is closed to ignite the ignition plug 5 causing explosive combustion of the air-gas mixture. The high pressure created by the explosive combustion closes the gas and air inlet ports 13 and 14 by the flapper valve 13*a*. At the same time, the combustion state is detected by the flame detector 6, and a predetermined time later the delay circuit 15 interrupts the ignition switch 16 and the fan switch 17. The combustion product is discharged to the outside via a heat exchanger for obtaining hot air or hot water. Then, the pressure in the combustion chamber decreases to a subatmospheric pressure so that air flows into the combustion chamber 4 through a suction port, not shown, of the fan and the air inlet ports 14, while the gas of a regulated quantity determined by the degree of opening of the electromagnetic valve 14 is also supplied to the combustion chamber to form a fresh air-gas mixture. At this time, although the ignition plug has been rendered inoperative, a portion of the exhausted combustion gas returns back into the combustion chamber and ignites the fresh air-gas mixture to create an explosion. This cycle of operation is repeated consecutively although the ignition plug and the fan have been stopped, thereby saving the operating power.

At the time of start, when the flame detector 6 fails to detect flame as a result of misignition, the delay circuit 15 closes the electromagnetic valve 12 to interrupt supply of gas. At the same time, the fan 9 is restarted to purge air-fuel mixture out of the combustion chamber. Then, the cycle of operation is restarted.

The operation of the pulse burner is stopped when electromagnetic valve 12 is closed and the fan is also stopped with a delay.

As above described, according to this invention, once the pulse burner has started normally the fan and the ignition plug are deenergized by the output signal of the flame detector, so that operating power during subsequent normal operation becomes unnecessary to improve the overall efficiency of the burner.

We claim:

1. A pulse burner comprising:

a combustion cylinder provided with an ignition plug;

a fuel inlet passage for supplying fuel into said combustion cylinder;

an air inlet passage connected to a fan for supplying combustion air into said combustion cylinder;

flapper valve means operated by pressure variations caused by explosion in said combustion cylinder and exhaust of combustion product therefrom, whereby the flapper valve means repeatedly opens and closes the fuel inlet passage and the air inlet passage; and a flame detector installed in said combustion cylinder for stopping operations of the ignition plug and the fan once the combustion has started normally.

2. The pulse burner as set forth in claim 1 wherein said combustion cylinder is divided into an explosion chamber and an air chamber by a partition wall, said flapper valve means, said flame detector and said ignition plug are installed in said explosion chamber, said air inlet passage and said fuel inlet passage are provided through said partition wall, and stop means is provided to limit opening movement of said flapper valve means.

3. The pulse burner as set froth in claim 1 wherein said flame detector detects electric current flowing through a flame, and wherein said pulse burner further comprises a delay circuit which controls energization of said ignition plug, an electrically operated valve contained in a fuel supply conduit and energization of said fan.

* * * * *